United States Patent [19]

Ginat

[11] Patent Number: 4,711,491

[45] Date of Patent: Dec. 8, 1987

[54] SWIVEL TILT MECHANISM FOR CHAIR

[76] Inventor: Jonathan Ginat, 26 W. 9th St., New York, N.Y. 10011

[21] Appl. No.: 872,192

[22] Filed: Jun. 9, 1986

[51] Int. Cl.[4] ..... A47C 3/00

[52] U.S. Cl. ..... 297/301; 297/304; 297/306

[58] Field of Search ..... 297/301, 300, 304, 305, 297/306

[56] References Cited

U.S. PATENT DOCUMENTS 4,333,683 6/1982 Ambasz ..... 297/300 X
4,555,085 11/1985 Bauer et al. ..... 297/304 X

FOREIGN PATENT DOCUMENTS 2001097 9/1971 Fed. Rep. of Germany ..... 297/301
2261788 7/1974 Fed. Rep. of Germany ..... 297/301
2925520 1/1981 Fed. Rep. of Germany ..... 297/301

*Primary Examiner*—James T. McCall
*Attorney, Agent, or Firm*—Kane, Dalsimer, Sullivan, Kurucz

[57] ABSTRACT

A chair includes a base, a member attached to the base and a seat support pivotable with respect to the member along a generally horizontal axis. The pivoting axis is disposed in parallel with and adjacent to a front edge of the seat. A backrest is hingedly connected to the seat. The seat has extreme forward and back tilt positions which may be selected in accordance with the task that is to be performed.

5 Claims, 10 Drawing Figures

SWIVEL TILT MECHANISM FOR CHAIR

BACKGROUND OF THE INVENTION

1. Field of Invention

This invention pertains to mechanisms for positioning the body attitude or inclination in a desk chair of the type used in offices.

2. Description of the Prior Art

Desk chairs used in offices are designed so that they can rotate or swivel about a vertical axis and tilt about a horizontal axis. Such chairs usually comprise a base resting on the floor, a chair frame including a seat, a backrest, lateral arm rests and a mechanism which permits the frame to rotate with respect to the base in two different planes as indicated above. The prior art mechanisms utilize rather complicated designs and are relatively expensive to make. Furthermore, the horizontal axis around which the frame typically tilts in the prior art mechanism is usually located far from the front edge of the seat so that during the tilting motion the front edge of the seat rotates severely upward. It was found that this type of motion is undesirable because it can interfere with the blood circulation in the legs of the person using the chair, causing muscle fatigue and other similar discomforts.

In addition existing desk chairs are uncomfortable because they do not follow all the body movement of the occupant, and do not support the body especially when the occupant leans forward toward a working position.

Furthermore, it is well-known that different tasks require different body positions. For example, certain tasks, such as typing, using a word processor, a microcomputer or a telecommunication terminal require a forward tilting position. Other tasks such as reading, or talking on a telephone prefer a backward leaning position. However, the prior art chairs presently available are adequate at most for only one of these positions.

OBJECTIVES AND SUMMARY OF THE INVENTION

In view of the above-mentioned disadvantages of the prior art, an objective, of the present invention is to provide a tilt mechanism for a swivel and tilt chair which alleviates the above-noted physical discomforts and which is also simple in construction and inexpensive to manufacture and assemble.

A further objective is to provide a mechanism in which the tilting axis is disposed close to the front edge of the seat thereby limiting the upward rotation of said front edge during tilting.

A further objective is to provide such a chair in which a compression spring is directly in the line of compression and the resistive force of the compression spring is in a line tangent to the arc of tilting of the chair seat resulting in the simplest and most efficient structure.

A further objective is to provide in such a chair, an adjusting lever which allows for easy adjustment of the seat/back pitch to that of preference of the person utilizing the chair.

Yet another objective is to provide a chair with a backrest resiliently pivotal with respect to the seat for increasing the tilting range backward and thus the comfort of the occupant.

Thus, there is provided an ergonomic chair.

Other objectives and advantages of the invention shall become apparent from the following description of the invention.

According to this invention a seat mechanism for a tilt-swivel chair comprises a first member generally disposed at an angle and rotatably mounted on a vertical shaft extending upwardly from the base, and a second member generally disposed horizontally and pivotably connected at one end to said first member at one end. This second member is adapted to support the chair frame. A compression spring is disposed between said first and second members to force them apart Means are provided for adjusting the tension of the spring and for adjusting the pitch of the second member in the rest position both in forward and backward position relative to a horizontal baseline. The chair frame includes a seat and a backrest, said backrest being hingedly connected to the seat.

More particularly, while the body can seek its own position the chair has two extreme positions: an extreme forward position in which the seat is tilted forward by about 5° during tasks requiring a forward leaning position; and an extreme backward position in which the seat is tilted backwards by about 15° during tasks requiring a backward leaning position. The backrest is further tiltable by an additional 10° backward with respect to the seat for the comfort of the occupant. Between the extreme forward and rear positions, the chair is infinitely adjustable by its occupant.

DESCRIPTION OF THE PREFERRED EMBODIMENT

Figure 1:
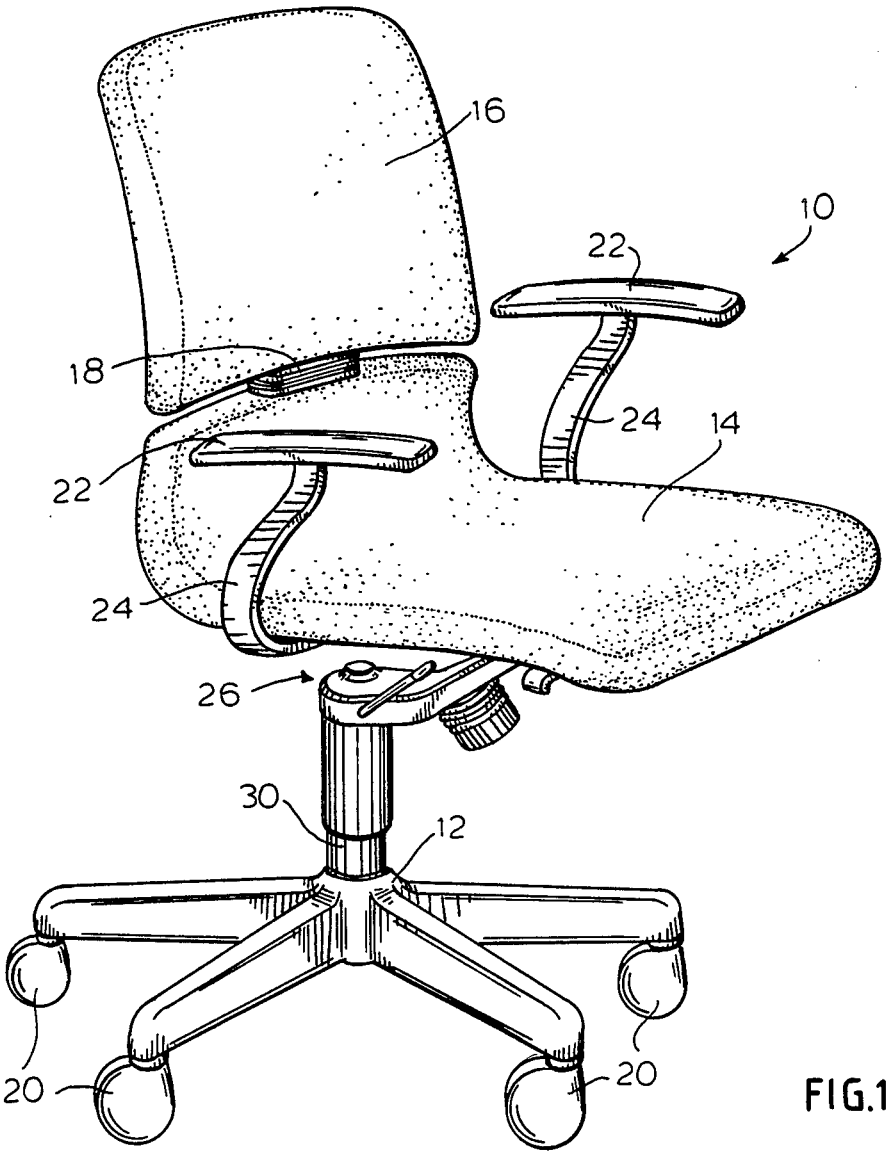
FIG. 1 is a perspective view of a swivel-tilt chair incorporating the seat support of the present invention.

A chair 10 constructed in accordance with this invention comprises, as shown in FIG. 1, a base 12, a seat and a backrest 14 and 16 respectively. The seat and the backrest are constructed of upholstery supported by a plastic shell, and a flexible hinge section 18 described more fully below. In the embodiment shown the base is mounted on casters 20 so that the chair may be rolled around at will. Lateral arm rests 22 are attached to the seat 14 by curved risers 24 as shown. The arms however are optional and may not be included in some embodiments.

Figure 2:
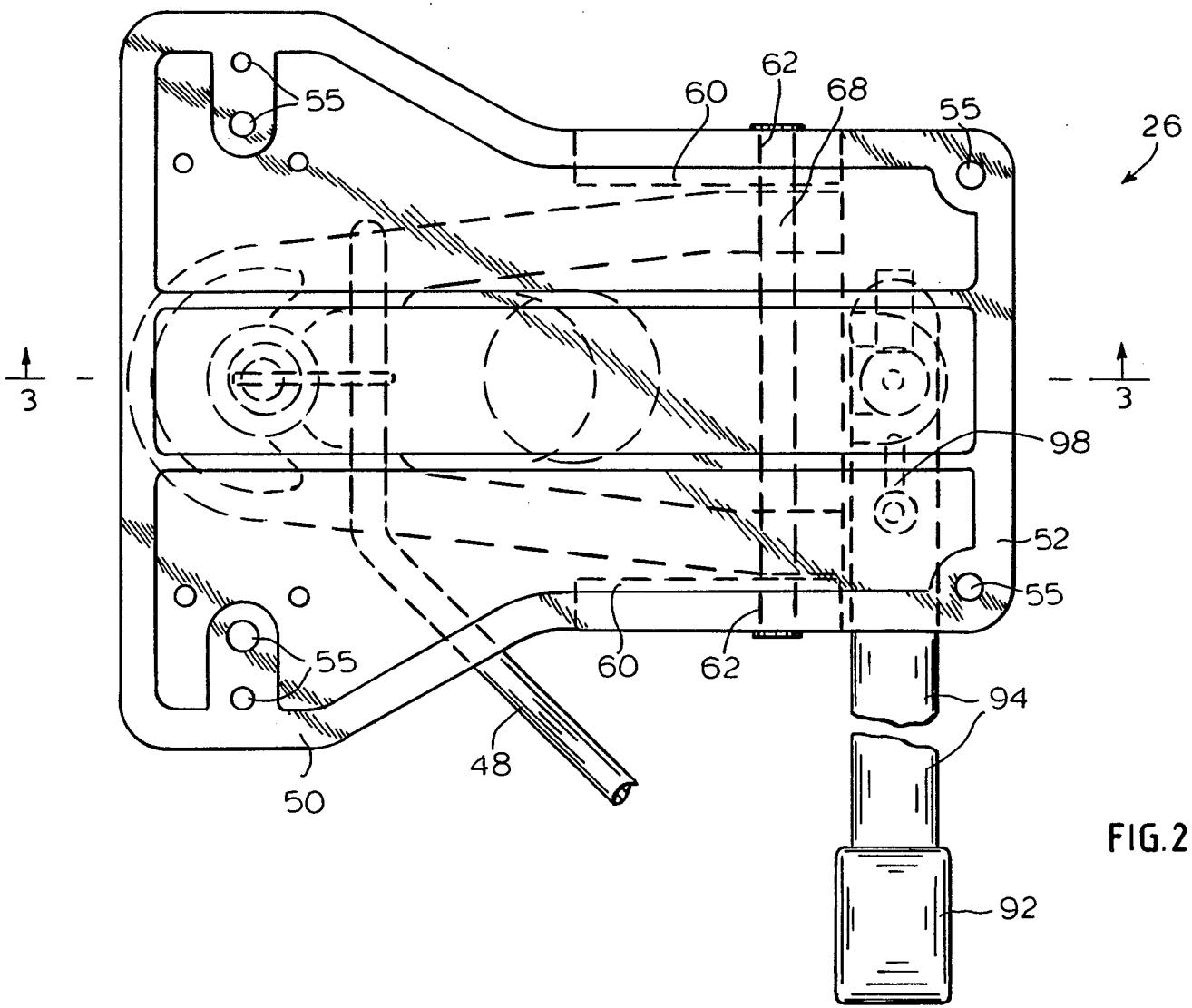
FIG. 2 is a plan view of the mechanism constructed in accordance with the invention.
Figure 3:
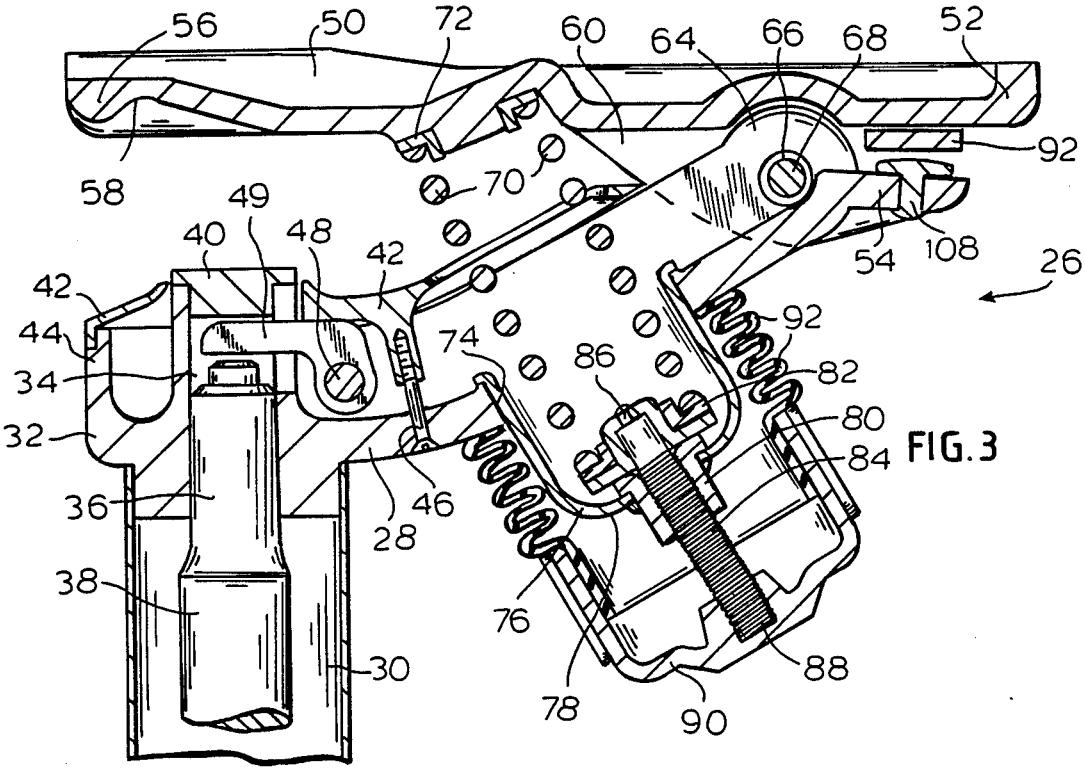
FIG. 3 a partially sectional view of the mechanism taken along the line 3—3 shown in FIG. 2.

The seat 14 is attached to the base by an interconnecting mechanism 26 shown in more detail in FIGS. 2 and 3. Mechanism 26 comprises a member 28, which is rotatably mounted on shaft 38 of the base 12 to permit the chair to swivel in the horizontal plane. To this end the member 28 which in the preferred embodiment is cast aluminum, is provided with hub 32 having an opening 34. The hub is arranged and constructed to fit over a tapered portion 36 of a height adjustable gas cylinder 38.

A cushioned cap 40 is used as a stop for member 56 described below. A plastic shroud 42 is used to cover the upper edges 44 of hub 32. The shroud 42 is secured to member 28 by a screw 46.

Height adjustment lever 48 is welded to finger 49 as shown in FIG. 3 and is constructed and arranged to permit the seat 14 to be raised or lowered as desired through utilization of the gas cylinder 38. This type of mechanism is known in the art.

Mechanism 26 is also provided with a plate 50. Plate 50 has a front portion 52 in an opposed relation with a horizontal lip 54 of member 28. The support plate is provided with holes 55 which are used to secure the seat 14 and the arm rests to the plate. A rear portion 56 of plate 50 has a contoured bottom profile as at 58 so that if the seat is pivoted backwards, the rear portion is cushioned by cap 40.

Plate 50 also has two extensions 60 facing downwardly, each extension having a hole 62. Similarly, member 28 has two lateral extensions 64 directed upward with holes 66. Member 50 is pivotably mounted on member 28 by axle 68 which is passed through holes 62, 66 as shown. A compression coil spring 70 is positioned between support plate 50 and member 28 in such a manner that it maintains plate 50 in a preselected rest position as described in more detail below. Plate 50 is formed with a downwardly extending cup 72 with an outer diameter equal to the diameter of the coil spring to maintain the upper end of the spring in position. At the opposite end of the spring, member 28 is provided with a hole 74 and a cup 76 affixed to member 28. The bottom surface 78 of cup 76 is provided with a threaded nut 80 which is affixed to cup 76. The lower end of spring 70 extends into the cup 76 and is terminated with a washer 82, as shown. A screw 84 is threaded through nut 80 with one end 86 engaging spring cup 76. The other end 88 of screw 84 is engaged by a handle 90. A protective bellows 92 is placed circumferentially around cup 76 to protect the spring 70 and the screw 84 from dust and dirt.

In FIG. 3, support 50 is shown rotated slightly counterclockwise for the sake of clarity, however, it is apparent from the above description, that it is urged clockwise by the spring 70.

Figure 4:
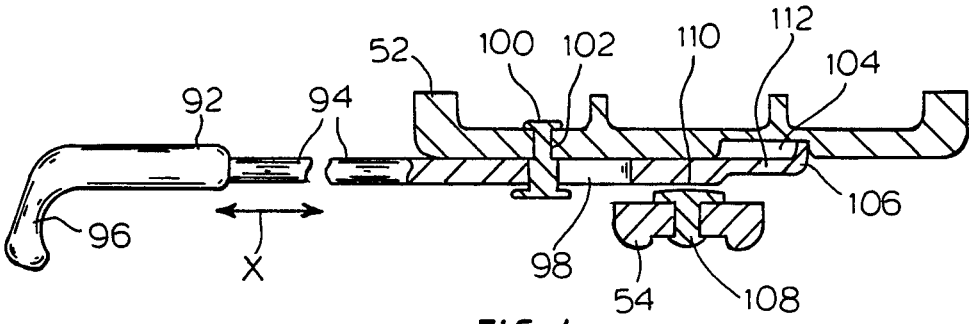
FIG. 4 shows details of the tilting lever.

Between front portion 52 of support 50 and lip 54 of member 28, there is a tilting lever 92 which determines the rest or forward-most position of the chair. More particularly, as shown in FIGS. 2 and 4, tilting lever 92 includes a generally flat section 94 which extends below front portion 52 and terminates in a handle 96. A longitudinal slot 98 is formed in section 94 (see FIG. 2) and a rivet 100 extends through support plate 50 to secure the lever 94. A groove or depression 104 is formed in the bottom surface of front support portion 52 (see FIG. 4) and lever 94 is terminated by a lip 106 disposed within groove 104. Slot 98, rivet 100, groove 104 and lip 106 cooperate to allow lever 92 to be shifted left and right as indicated by arrow "X" in FIG. 4.

Lip 54 is provided with a resilient cushion 108 which abuts section 94 of lever 92 when the chair is in the extreme position. Thus, the angle of support plate 50 with respect to the horizontal plane during its normal or rest position is determined by the thickness of lever section 94. The lever section is provided with a plurality of regions of different thicknesses, such as region 110, and 112. The lever 92 is constructed and arranged so that when it is in its rightmost position (seen in FIG. 4) the region with the greatest thickness 110 is disposed between cushion 108 and support plate 52, preventing it from tilting forward but allowing it to tilt backwards by a preselected angle from the horizontal, up to about 15°. In the leftmost position of lever 92 the thinnest region 112 is disposed between cushion 108 and support plate 52, allowing the plate to tilt forward by any angle, such as about 5°. Thus, the seat has two extreme forward positions which are selected by the lateral operation of the lever 92. The tilting is the result of body movement acting on a responsive mechanism.

Figure 5:
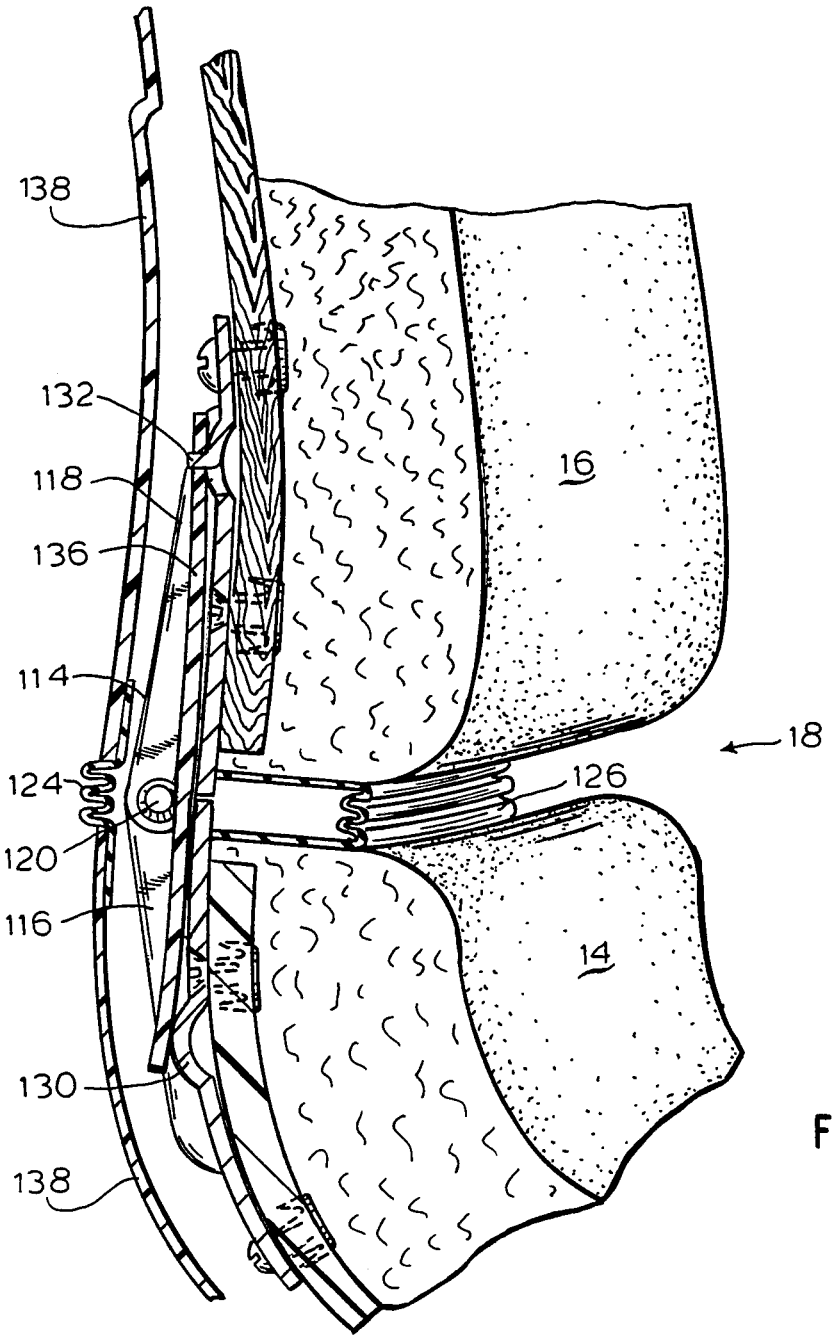
FIG. 5 is a segmentary view illustrating the spring hinge connecting the backrest to the seat.
Figure 6:
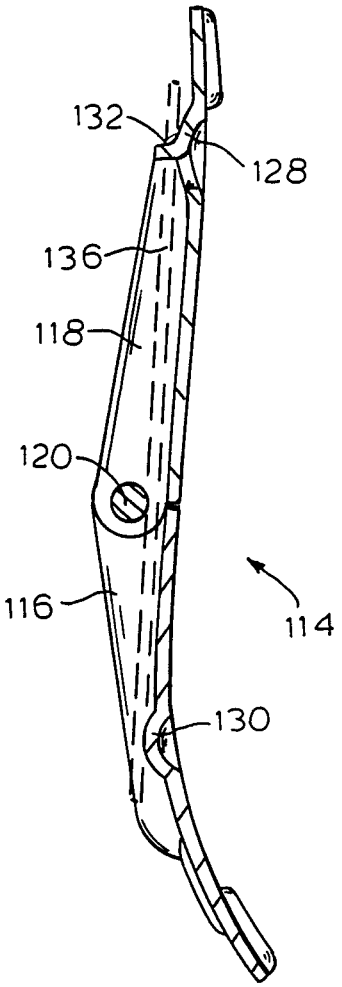
FIG. 6 shows a side view of the hinge plate of FIG. 5.
Figure 7:
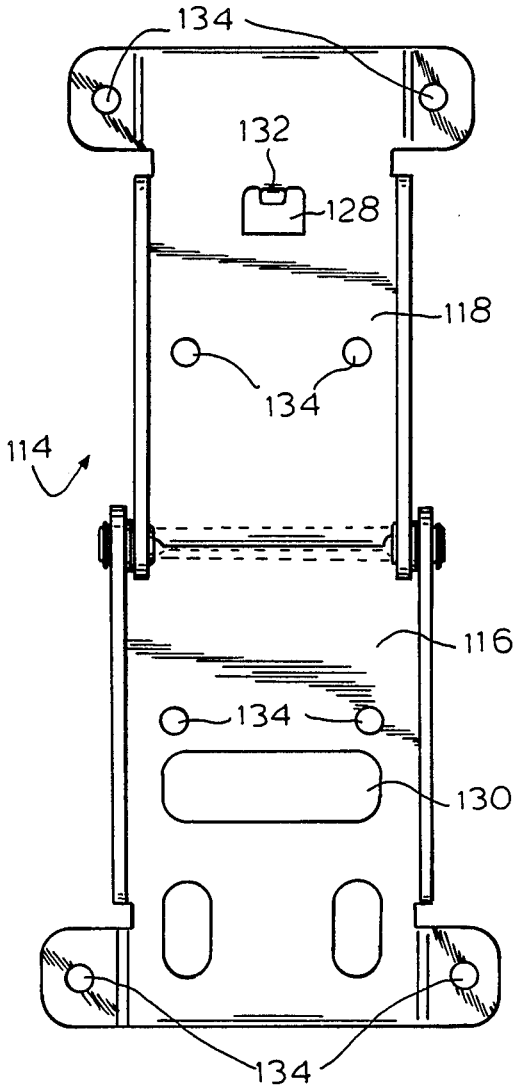
FIG. 7 shows a plan view of the hinge plate of FIG. 6.

Referring now to FIGS. 5, 6 and 7, seat 14 is connected to backrest 16 by a flexible section 18. Section 18 includes a hinge 114 having two hinge leaves 116 and 118 pivotably connected by pin 120. Preferably, hinge 114 is hidden from view by rubber bellows 124, 126 and plastic covers 138 shown in FIG. 5. Leaves 116, 118 are each formed with a bowed section 128, 130. Preferably, as seen in FIGS. 5 and 6, the upper bowed section 128 is provided with a raised finger 132. The two hinge leaves are provided with mounting holes 134 by which the leaves are secured to the seat and backrest respectively.

A relatively flat spring 136 is hung from finger 132 and is pretensioned into a slightly bowed position by bowed section 128, pin 120 and bowed section 130, as shown in FIG. 5. This spring 136 cooperates with the bowed sections 128, 130 to permit the backrest to pivot backward by up to about 10°. When released, the backrest is returned to a normal position by the spring 136. Spring 136 is preferably made of a plastic material such as fiberglass so that it is strong, yet flexible.

Figure 8:
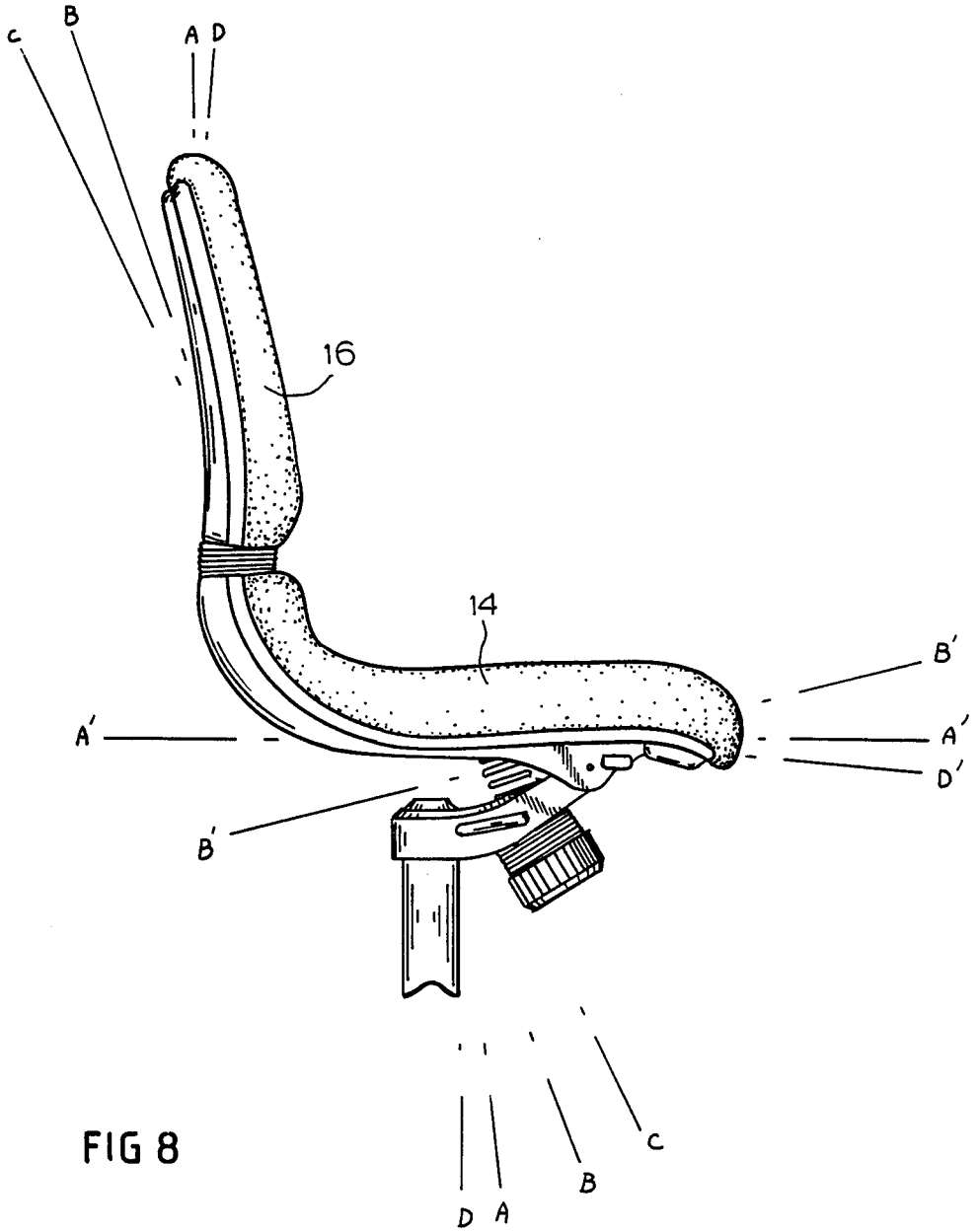
FIG. 8 shows a side view of a chair constructed in accordance with this invention in an extreme forward position.
Figure 9:
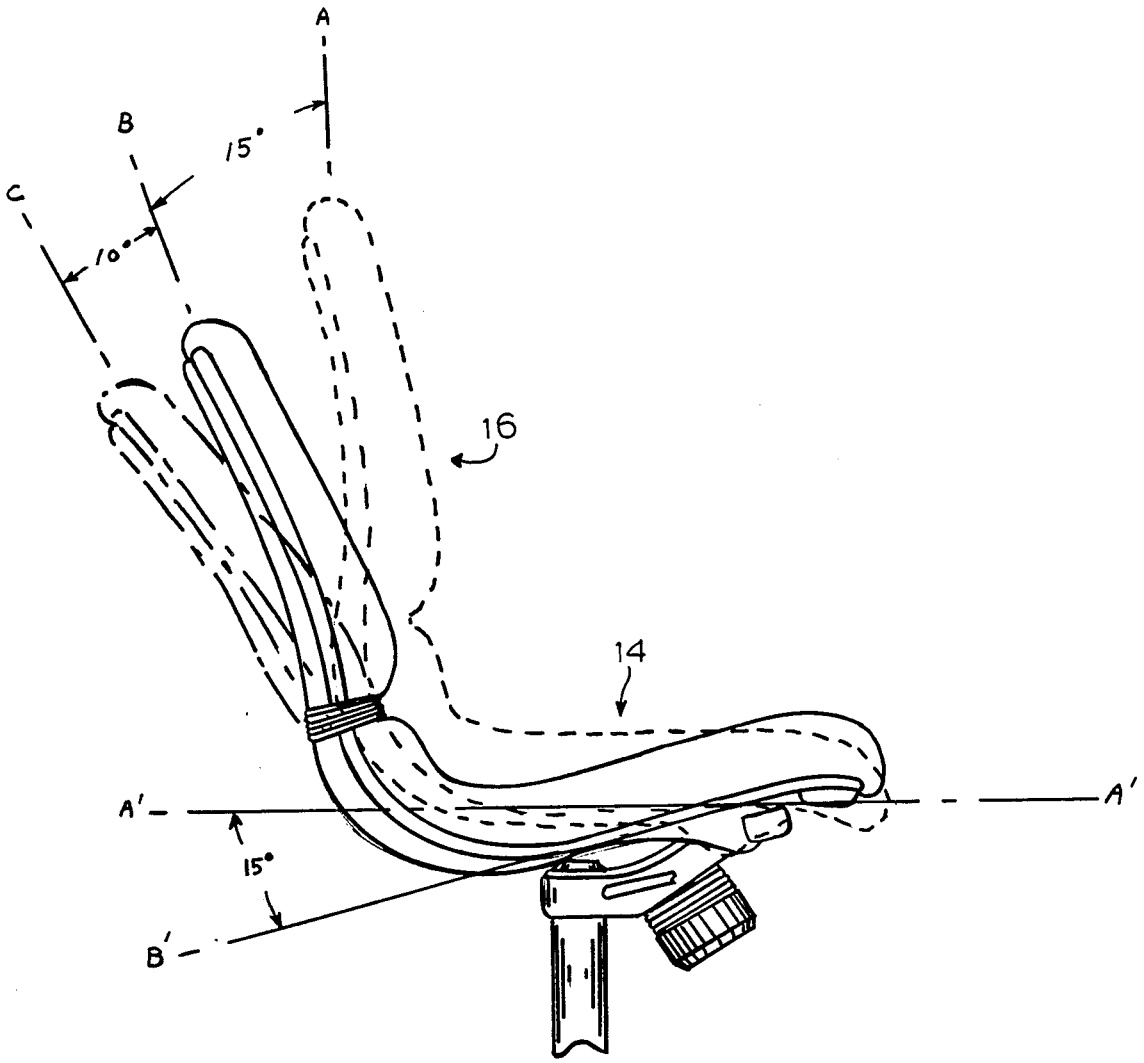
FIG. 9 shows the chair of FIG. 8 tilted backward.
Figure 10:
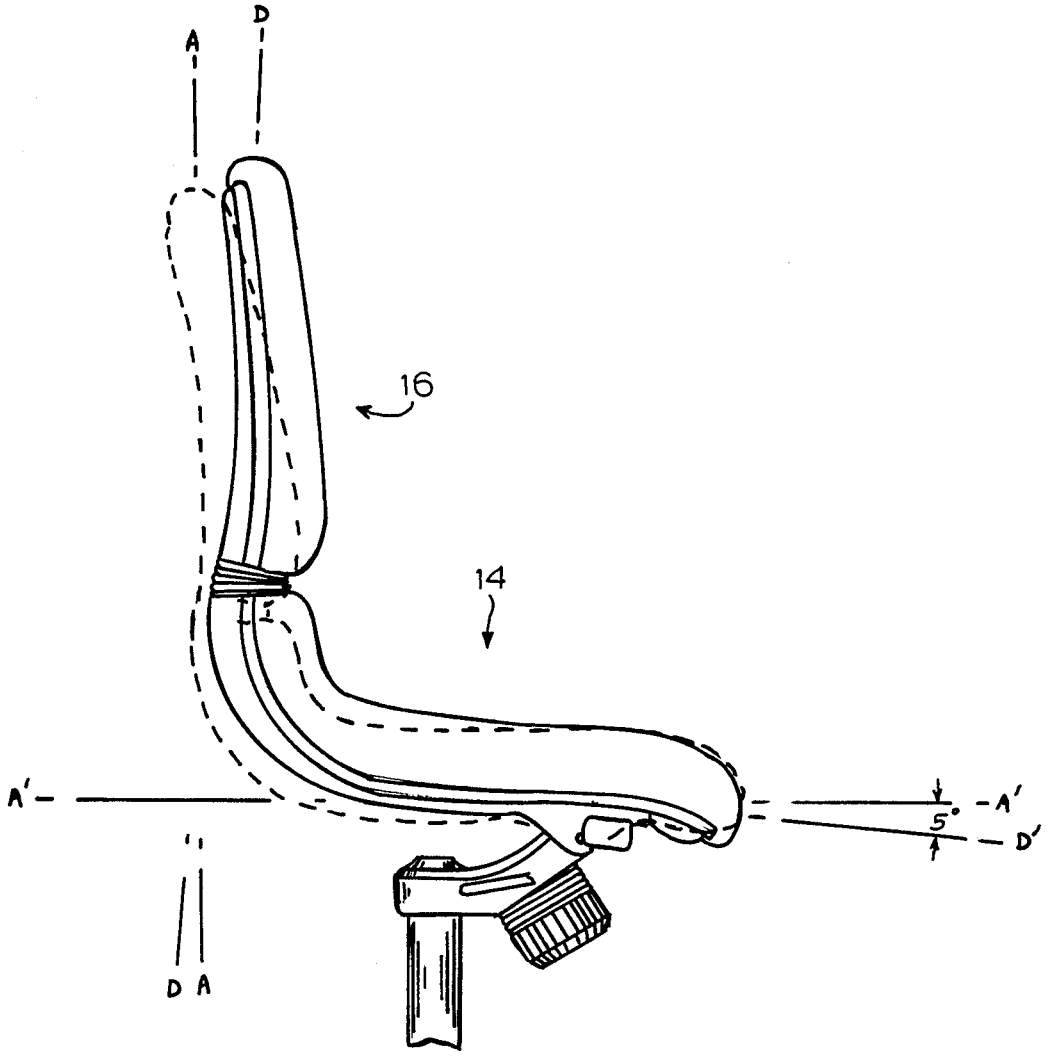
FIG. 10 shows the chair of FIG. 8 tilted forward.

The various positions of the chair are illustrated in FIGS. 8–10. With the lever 92 in the right-most position defined above, the chair is preset so that it has a first extreme position in which the seat is tilted backwards by about 15° along axis B'—B' with respect to a horizontal axis A'—A'. Similarly the back is tilted backwards by about 15° along axis B—B, as shown in FIG. 9. In this position the chair may be used for tasks such as reading or talking on the telephone. Of course, the seat and the backrest are continuously automatically adjustable by the occupant's body movements from the extreme forward position. In addition the back could be tilted up to an additional 10° (along axis C—C) for the further comfort of the occupant.

When the lever 92 is in the left-most position, the seat and the backrest are in a second extreme forward position in which they are tilted forward up to about 5° so that they are oriented along axes D—D and D'—D' respectively, as shown in FIG. 10. Of course, the backrest is still independently tiltable backwards by about 10° as discussed before. This forward position is preferable for some other tasks such as writing.

Thus the various positions may be set in accordance with the task to be performed. When a person sits on seat 14, support 50 rotates around axle 68 counterclockwise, the compressing the spring 70. The final position of the seat depends on the weight of the person and the tension of the spring 70. This position may be adjusted by turning handle 90 to cause spring cup 82 to move toward or away from the surface decreasing or increasing the spring tension respectively. However, it should be appreciated that, except for the extreme forward position, the chair is infinitely adjustable to suit the needs of the occupant.

Importantly since the distance between the front edge of seat 14 and axle 62 is relatively short, as the seat is tilted rearwardly, the front edge rises only over a short distance leaving the pressure on the legs and the blood circulation of the person resting in the chair substantially unaffected.

Swivelling of the frame 14 is permitted by the interface between hub 34 and cylinder 22 in the normal fashion.

Obviously numerous modifications may be made to the subject application without departing from its scope as defined in the appended claims.

What is claimed is:

1. A chair comprising:

a base;

a member mounted on said base;

a seat support pivotably attached to said member;

spring means for urging said seat support towards a rest position with respect to said member; and tilting means for changing said rest position, wherein said tilting means comprises a flat member with variable thickness disposed between said member and said seat support, said flat member being shiftable to change the distance between said member and said seat support.

2. The chair of claim 1 further comprising a backrest hingedly connected to said seat support and resilient means for urging said backrest towards a backrest position with respect to said seat.

3. The chair of claim 2 wherein said resilient means comprises a leaf spring disposed tangentially between said backrest and said seat support.

4. A chair comprising:

a base;

a member mounted on said base;

a seat support pivotably attached to said member;

spring means for moving said seat support towards a rest position with respect to said member; and a tilting lever which abuts a front position of said seat support and is movable such that the distance between said member and said seat support is changed whereby the height of said front position of said seat is also changed.

5. The chair of claim 4 wherein said member comprises a substantially vertical shaft.

* * * * *